US008234999B2

(12) United States Patent
Messerschmid

(10) Patent No.: US 8,234,999 B2
(45) Date of Patent: Aug. 7, 2012

(54) DEVICE FOR THE APPLICATION OF ADHESIVE AND MACHINE AND METHOD FOR MANUFACTURING PAPER CUPS

(75) Inventor: Uwe Messerschmid, Albershausen (DE)

(73) Assignee: Michael Hoerauf Maschinenfabrik GmbH & Co. KG, Donzdorf (DE)

( * ) Notice: Subject to any disclaimer, the term of this patent is extended or adjusted under 35 U.S.C. 154(b) by 196 days.

(21) Appl. No.: 12/653,473

(22) Filed: Dec. 15, 2009

(65) Prior Publication Data

US 2010/0154983 A1 Jun. 24, 2010

(30) Foreign Application Priority Data

Dec. 22, 2008 (DE) ..... 10 2008 064 502
Nov. 20, 2009 (DE) ..... 10 2009 055 986

(51) Int. Cl.
*B05C 5/02* (2006.01)

(52) U.S. Cl. ..... 118/323; 118/325; 118/44; 156/443; 425/385; 425/405.1; 425/406

(58) Field of Classification Search ..... 118/323, 118/304, 325, 44; 101/327; 156/443, 217; 401/265, 266, 261; 222/187, 479, 394, 189.1, 222/189; 425/385, 405.1
See application file for complete search history.

(56) References Cited

U.S. PATENT DOCUMENTS 4,386,576 A * 6/1983 Johnson ..... 118/211
4,925,327 A * 5/1990 Wirt ..... 401/205
2005/0227011 A1* 10/2005 Kufner et al. ..... 427/402

FOREIGN PATENT DOCUMENTS

EP 1203619 A2 * 5/2002
JP 63-049275 * 3/1988

* cited by examiner

*Primary Examiner* — Laura Edwards
(74) *Attorney, Agent, or Firm* — Flynn, Thiel, Boutell & Tanis, P.C.

(57) ABSTRACT

A device for the application of adhesive and machine and method for manufacturing paper cups. The device applies adhesive, particularly for the manufacture of a paper cup from at least one paper segment, and includes a stamp for the application of the adhesive. The stamp is made of a compression-resistant porous sintered material.

11 Claims, 4 Drawing Sheets

DEVICE FOR THE APPLICATION OF ADHESIVE AND MACHINE AND METHOD FOR MANUFACTURING PAPER CUPS

FIELD OF THE INVENTION

The present invention relates to a device for the application of adhesive, more particularly for the manufacture of a paper cup from at least one paper segment, which device comprises a stamp for applying the adhesive. The invention also relates to a machine and to a method for the manufacture of paper cups.

BACKGROUND OF THE INVENTION

In the production of paper cups from segments of paper material, it is known to produce these cups from paper that is coated on one or both sides with polyethylene (PE). Such coated paper segments can be joined to each other by sealing, that is to say, by heating the plastic layer. A primer or an adhesion promoter is used at critical sites for increasing the sealability. Such a primer is a type of adhesive and substantially consists of a low-viscosity aqueous polymer solution. Such a primer is applied to the paper segment, for example, with the aid of felt saturated with the primer. The low viscosity of the primer causes the machine to be soiled relatively severely, and the felt used for applying the primer is also subjected to considerable wear and has consequently to be replaced at regular intervals. It is further known to pre-break paper segments, whether coated or uncoated, at a segment edge before they are wound up on a folding mandrel, in order to facilitate the winding process and particularly the production of an overlap on the breaking mandrel. Uncoated paper segments are coated with adhesive in the region of the overlap and then glued to form a sleeve.

SUMMARY OF THE INVENTION

The invention relates to the provision of an improved device for the application of adhesive and to an improved machine and an improved method for the production of paper cups.

For this purpose, a device is provided, according to the invention, for the application of adhesive, more particularly for the production of a paper cup from at least one paper segment, which device comprises a stamp for applying the adhesive, which stamp is made of compression-resistant porous sintered material.

It has been found, surprisingly, that adhesive and particularly a low-viscosity primer or adhesion promoter can be readily applied with the aid of a stamp made of compression-resistant porous sintered material. By virtue of the fact that the stamp is made of rigid, non-resilient sintered material, there is practically no wear on the stamp. Furthermore, it is possible to simultaneously apply adhesive and shape the paper segment by pressing the stamp against the paper. It has also been observed, surprisingly, that the adhesive does not create blots or continue to drip at sites other than the intended points of application even in the case of very low-viscosity adhesive such as a primer. Also in the case of very low-viscosity aqueous adhesives, it is possible to achieve a very economical consumption of adhesive. Moreover, it is extremely easy to clean the sintered material, since the stamp can simply be fully immersed in solvent or rinsed with the same.

In a development of the invention, the adhesive is supplied from an adhesive supply line to an adhesive applying surface of the stamp, at least partially through the porous sintered material of the stamp.

Such an embodiment of the device of the invention is suitable for high cycle rates in the production of paper cups. A continuous supply of adhesive is readily achieved by means of a pressure line. In the case of very low-viscosity adhesive, the application of pressure can, for example, be left until the stamp is resting on the paper segment. With the exception of the adhesive applying surface of the stamp, the other outer surfaces of the stamp are sealed, for example, by simply closing the sintered material by grinding. By virtue of the fact that the adhesive is supplied through the porous sintered material of the stamp, a uniform distribution of adhesive can be achieved over the entire adhesive applying surface of the stamp.

In a development of the invention, the sintered material is sintered metal.

Sintered metal is compression-resistant and wear-resistant. The flow resistance of sintered metal is suitable for supplying adhesive.

In a development of the invention, the porosity of the sintered material is adapted to match the viscosity of the adhesive to be used, the supply pressure in the adhesive supply line and the intended rate of application of the adhesive.

In this way, it can be ensured that the exact amount of adhesive required is applied accurately to the paper segment at all times. A low consumption of adhesive can thus be achieved particularly for the series production of paper cups at high cycle rates.

In a development of the invention, the adhesive applying surface is provided with a curved shape.

In this way, the paper segment can be partly shaped at the same time as the application of adhesive and, for example, a segment edge can be pre-broken concurrently with the application of adhesive in order to facilitate the subsequent winding process of the paper to form a cup sleeve.

In a development of the invention, the adhesive applying surface is shaped in the form of a section of a sleeve of a circular cylinder. In this way, the segment edge can be pre-broken reliably in a manner that facilitates the subsequent winding process.

The problem underlying the invention is also solved with the aid of a machine for the production of paper cups, which machine comprises a device of the invention for the application of adhesive. In such a machine, the device for the application of adhesive can be provided in a pre-breaking station for at least partial formation of a paper segment. In this way, the formation of the paper segment and the pre-breaking process can be effected concurrently with the application of adhesive and it is possible to economize on an additional processing station, if necessary.

The problem underlying the invention is also solved by a method for the production of paper cups, which method comprises the following steps: placing the adhesive applying surface of a stamp made of compression-resistant porous sintered material on a portion of a paper segment to be subjected to gluing, supplying adhesive from an adhesive supply line through the sintered material of the stamp to the adhesive applying surface and joining the paper segment by adhesion to form a cup sleeve by producing an overlap over at least that portion of the paper segment to which adhesive has been applied.

In a development of the invention, the paper segment is deformed at the same time as the stamp is placed thereon.

Advantageously, one edge of the paper segment is pre-broken concurrently with impression by the stamp.

BRIEF DESCRIPTION OF THE DRAWINGS

Additional features and advantages of the invention will become apparent from the claims and the following description of preferred embodiments of the invention, with reference to the drawings. Individual features of the different embodiments illustrated can be combined with each other in any desired way without going beyond the scope of the invention. In the drawings:

DETAILED DESCRIPTION OF PREFERRED EMBODIMENTS

Figure 1:
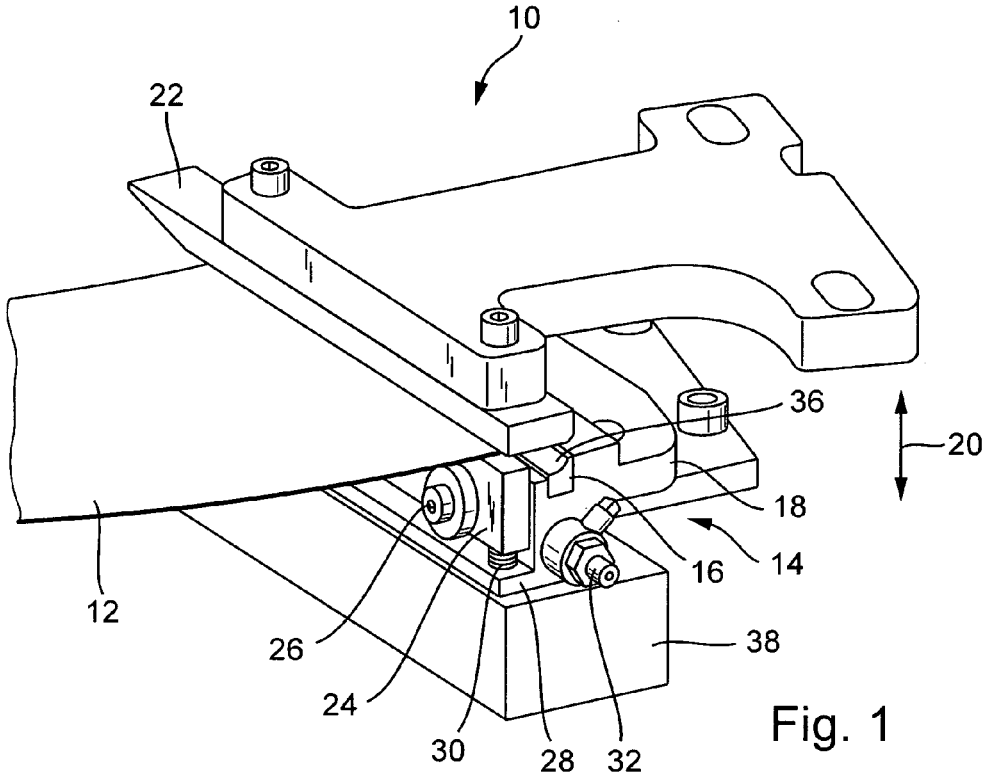
FIG. 1 is a sectional view of a device of the invention for the application of adhesive.

A pre-breaking station 10 of a machine for producing paper cups is shown in FIG. 1. Paper segments 12 that are coated by a plastics material on one side are processed to form paper cups with the aid of such a machine. At the pre-breaking station 10, the paper segment 12 is deformed in the region of one edge and, at the same time, adhesive is applied in the region of this deformed edge with the aid of a device 14 for the application of primer. The term "primer" denotes a special adhesive that forms an aqueous solution containing plastics material. This primer is applied to the plastic-coated side of the paper segment 12 and serves as an adhesion promoter in the process of thermally sealing the paper segment 12.

Downstream of the pre-breaking station 10, the pre-broken paper segments 12 provided with primer are wound on a folding mandrel and joined to each other in the region of a resulting overlap by means of a thermal sealing process. The finished cup sleeve is then provided with a bottom and optionally with a mouth roll. For example, it is possible to push on an additional, insulating sleeve made from another paper segment, in order to produce a double-walled insulating cup.

The device 14 for the application of adhesive comprises a stamp 16 made of a porous but compression-resistant sintered metal. This stamp 16 is attached to a stamp carrier 18 that can be moved up and down in the directions of the double arrow 20. The stamp 16 is also referred to as the "lower pre-breaking bar" and is moved toward an upper pre-breaking bar 22 when moved upwardly. The paper segment 12 present between the stamp 16 and the upper pre-breaking bar 22 is consequently deformed since it is bent up in the region of its edge (not visible in FIG. 1). The stamp carrier 18 is attached to a mainframe 24 for vertical displacement with the aid of screw bolts 26 which can slide up and down in elongated holes (not visible) in the mainframe 24. A balcony-like projection 28 of the stamp carrier 18 is biased with the aid of a pressure spring 30 in a downward direction away from the upper pre-breaking bar 22.

In the stamp carrier 18, a liquid duct is provided which can be connected by means of a union 32 to an adhesive supply line. Starting from the union 32, adhesive—in the present case, the so-called primer—can flow into the liquid duct and up to the stamp 16 by way of a number of branch ducts. The primer is pressurized and can therefore spread out inside the stamp 16 consisting of porous sintered metal. The primer is thus discharged at an adhesive applying surface 36 of the stamp 16, which surface has a curved shape and, in particular, the shape of a section of the sleeve of a circular cylinder. When the stamp 16 is moved in the direction of the upper pre-breaking bar 22, a paper segment 12 present between the stamp 16 and the upper pre-breaking bar is thus deformed in the region of its edge and provided with primer on one side thereof.

A collecting trough 38 is provided below the stamp carrier 18 to collect any primer that may emerge. The exposed lateral surfaces of the stamp 16 are sealed with the exception of the adhesive applying surface 36 so that the primer can be discharged exclusively at the adhesive applying surface 36. Such sealing of the stamp 16 can be effected by simply closing the lateral surfaces to be sealed by grinding.

Figure 2:
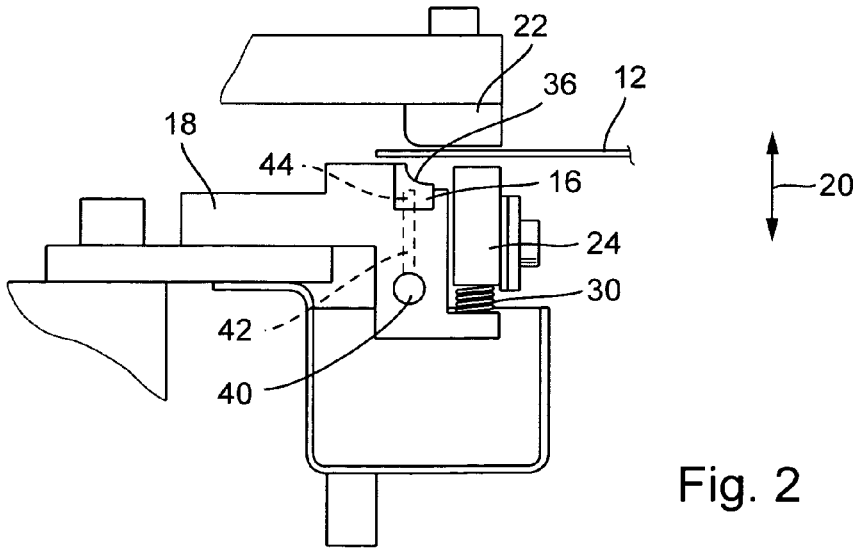
FIG. 2 is a lateral view of the device shown in FIG. 1.

FIG. 2 illustrates a side view of the pre-breaking station 10 shown of FIG. 1. An end plug 40 is clearly seen in the stamp carrier 18. The diameter of the end plug 40 is equal to that of a liquid duct running transversely through the stamp carrier 18 into the drawing plane of FIG. 2, that is to say, parallel to the stamp 16, and the union 32 for the adhesive supply line is provided on the rear side (not visible in FIG. 2) of the liquid duct. Starting from the liquid duct closed with the aid of the end plug 40, branch ducts 42 extend inside the stamp carrier 18 upwardly and toward the stamp 16. These branch ducts 42 are actually not visible in FIG. 2 and are therefore indicated by dashed lines. The stamp 16 is provided with blind bores 44 in continuation of the branch ducts 42, which blind bores likewise cannot in fact be seen and are therefore indicated by dashed lines. The low-viscosity primer flows through the branch ducts 42 and the blind holes 44 into the interior of the stamp 16 and, since the exposed lateral surfaces of the stamp 16 are sealed with the exception of the adhesive applying surface 36, this low-viscosity primer is discharged exclusively in the region of the adhesive applying surface 36. It can be clearly seen that the curvature of the adhesive applying surface 36 is adapted to match that of the upper pre-breaking bar 22 so that the paper segment 12 is accommodated between the convexly curved edge of the upper pre-breaking bar 22 and the concavely curved adhesive applying surface 36 and, as a result, is curved upwardly when the stamp carrier 18 is moved upwardly against the force of the pressure spring 30. The stamp carrier 18 can be pushed upwardly by pneumatic means, for example. While the adhesive applying surface is resting against the paper segment 12, the primer is discharged and that portion of the paper segment 12 which is adjacent to the adhesive applying surface 36 is wetted by the primer.

The porosity of the stamp 16 is adapted to match the viscosity of the adhesive used and the intended rate of application of the adhesive to the paper segment 12. Advantageously, the primer is supplied to the union 32 under pressure in the adhesive supply line, and it may be advantageous to switch on the pressure means only when the stamp carrier 18 has been moved upwardly and the paper segment 12 has been clamped between the stamp 16 and the upper pre-breaking bar 22. As soon as the stamp carrier 18 has moved down again, the pressure is removed from the adhesive supply line so that no further primer can be discharged from the adhesive applying surface 36.

Figure 3:
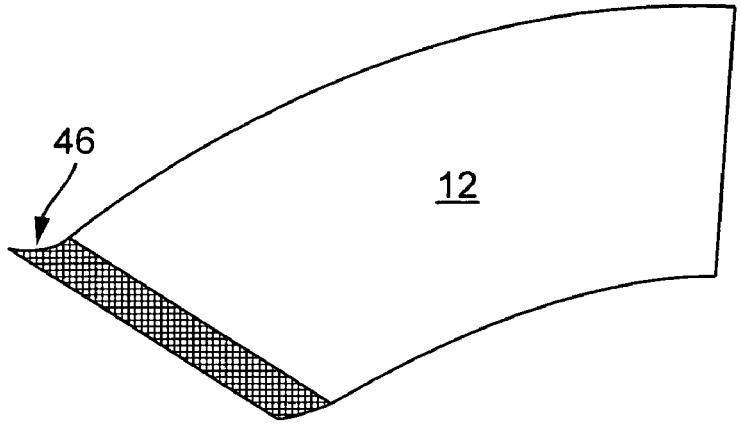
FIG. 3 is a view, taken obliquely from above, of a paper segment used for producing a paper cup.

FIG. 3 diagrammatically shows the paper segment 12 in a pre-broken state in which a region 46 adjoining a left segment edge in FIG. 3 is curved upwardly. It is also apparent from FIG. 3 that primer has already been applied to this upwardly curved region 46, which is indicated by light gray shading.

Figure 4:
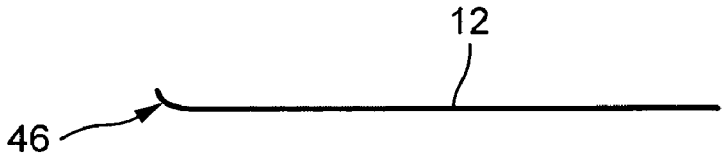
FIG. 4 is a side view of the paper segment shown in FIG. 3.

FIG. 4 shows a side view of the paper segment 12. The primer is applied to the convex side of the region 46.

Figure 5:
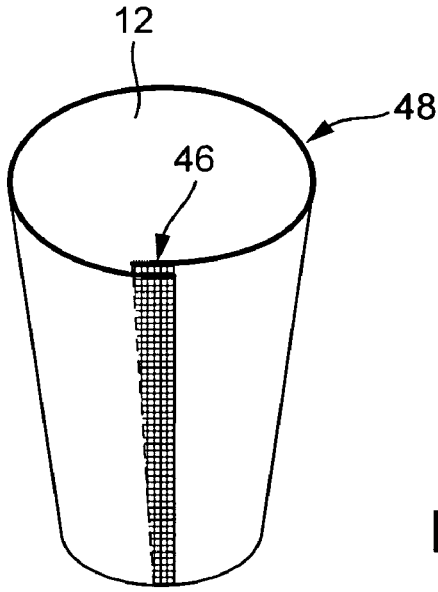
FIG. 5 is a view of a cup sleeve produced from the paper segment shown in FIG. 3.

FIG. 5 now shows a finished cup sleeve 48 as created by winding the paper segment 12 on a folding mandrel and sealing it in the region of an overlap. The overlap is produced in the region in which the pre-broken region 46 had been supplied with primer. This considerably stabilizes and improves a bond produced by a thermal sealing process in the region of the overlap. Thus there is no difficulty in forming a mouth roll at the top edge of the cup sleeve 48 of larger diameter due to the conical shape of the cup sleeve 48, without breaking the seal in the region of the overlap as a result of the rolling process.

Since the stamp 16 is made of compression-resistant porous sintered material, it is subject to virtually no wear and also has a very long service life at high cycle rates in the production of paper cups. If, for example, any primer remaining in the stamp becomes touch-dry after long production downtimes, the stamp 16 can be easily cleaned by removing the entire stamp 16 and immersing it in solvent or rinsing it with the same. The device 14 of the invention for the application of adhesive thus provides a much more reliable bond in the region of the overlap during production of a cup sleeve 48 and can furthermore almost completely avoid downtimes caused by cleaning or maintenance.

Figure 6:
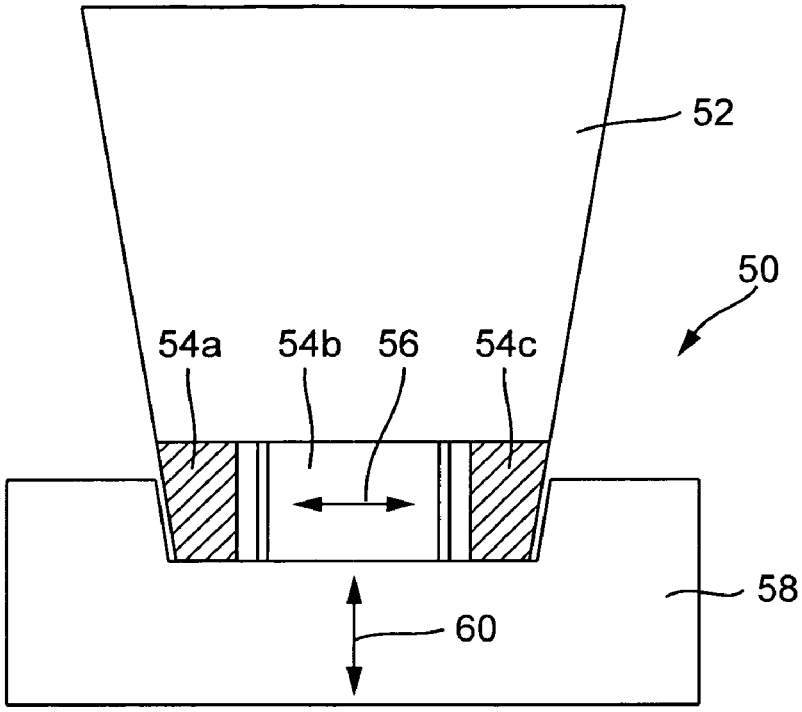
FIG. 6 is a diagrammatic sectional view of another device of the invention for applying adhesive.

The diagrammatic illustration in FIG. 6 shows another device 50 of the invention for the application of adhesive. The device 50 is shown diagrammatically as a side view. The device 50 serves to provide a truncated conical paperboard sleeve with adhesive on the inner side in the region of its lower edge. Such an adhesive or primer application at the lower end of the sleeve can assist in improving the leak-tightness of the skirt joining the bottom edge to the lower edge of the sleeve after the insertion of the bottom and thus seals the paper cup to make it leak-proof for liquids. For this purpose, the device 50 comprises three stamps 54*a*, 54*b*, and 54*c*, which are each made of a sintered material such as a sintered metal and are pervious to the primer to be applied. The means used for supplying the stamps 54*a*, 54*b*, 54*c* with adhesive and for forcing the adhesive therethrough are not shown for the sake of clarity.

The stamps 54*a*, 54*b*, 54*c* together form the shape of a ring comprising a truncated cone-shaped outer surface and a cylindrical inner surface and circular ring-shaped top and bottom surfaces. Each of the stamps 54*a*, 54*b*, 54*c* forms a circular ring segment and extends over an angular range of only about 120°. The stamps 54*a*, 54*b*, 54*c* can be moved outwardly in the radial direction as indicated by the arrows 56. For moving or expanding the stamps 54*a*, 54*b*, 54*c* in the radial direction, a mandrel is used, for example, which is inserted into the inner space of the circular ring formed by the three stamps 54*a*, 54*b* and 54*c*. As a result of the radial movement of the stamps 54*a*, 54*b*, 54*c*, the latter come to rest against the inner side of the paperboard sleeve 52. A limit is set for the radial movement of the stamps 54*a*, 54*b*, 54*c* in that they move toward the truncated cone-shaped inner surface of a counter tool 58. The lower edge of the sleeve 52 is then clamped between the truncated cone-shaped inner surface of the counter tool 58 and the outer surface of the stamps 54*a*, 54*b*, 54*c* and adhesive is applied at the same time to the region against which the stamps 54*a*, 54*b*, 54*c* bear.

Figure 7:
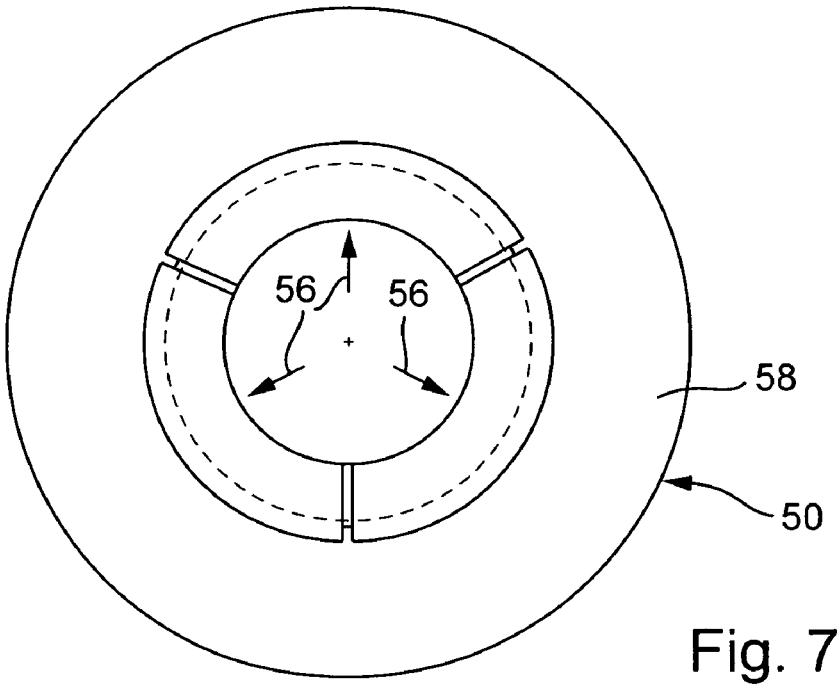
FIG. 7 is a diagrammatic top view of the device shown in FIG. 6.

FIG. 7 shows the device 50 illustrated in FIG. 6 in a diagrammatic top view. The arrows 56 denote the expanding movement of the ring formed by the stamps 54*a*, 54*b* and 54*c*. The counter tool 58 can likewise be open below the free inner space of the ring formed by the stamps 54*a*, 54*b*, 54*c*, in order to be able to insert or slide in an expanding mandrel. As indicated by the double arrow 60 in FIG. 6, the counter tool 58 can be advanced in the longitudinal direction of the paperboard sleeve 52 toward the stamps 54*a*, 54*b*, 54*c*.

Figure 8:
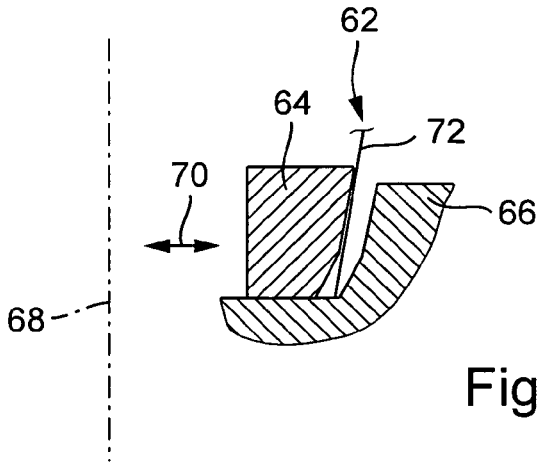
FIG. 8 is a diagrammatic sectional view of another device of the invention for the application of adhesive.

FIG. 8 shows a section of another device 62 of the invention for the application of adhesive. The design of the device 62 is basically similar to that of the device 50 shown in FIG. 6. Altogether three circular ring segment-shaped stamps 64, of which only one segment is shown partially in FIG. 8, are made at least partly of sintered material and can be moved outwardly in the radial direction to bear against the lower edge of a paperboard sleeve. The paperboard sleeve is not shown in FIG. 8, but is present in the annular gap between the stamp 64 and a counter tool 66. The stamp 64 has various chamfers in the region of its outer surface. From the base of a depression in the counter tool 66, that is, starting from the bottom edge of a paperboard sleeve provided with an adhesive in the device 62, the outer surface of the stamp 64 forms an angle of about 30°. The angle of the outer surface of the stamp then changes as its movement is continued to finally assume, for example, an angle of about 10° to a central longitudinal axis of the ring formed by the stamp segments 64. When viewed from the bottom edge of the stamps 64, the angle to a central axis 68 is thus initially acute and then becomes more obtuse and is substantially equal, in the more obtuse region, to the inclination angle of the sleeve.

The inner surface of the counter tool 66 is also designed accordingly so that a paperboard sleeve supplied with adhesive in the device 62 is simultaneously pre-broken in that the lowermost edge section of the paperboard sleeve is bent inwardly. The sleeve can thus be subjected to a pre-breaking action during the application of primer, which facilitates the process of turning over the lower edge when forming the skirt in a subsequent process step, that is to say, when the lower edge of the sleeve is joined to the edge of a bottom element in order to seal the cup, making it leak-proof for liquids.

During operation, the sleeve 72, shown partially and diagrammatically, is inserted in the gap formed between the stamp segments 64 and the counter tool 66 and the stamps 64 are then moved outwardly in the radial direction and then retracted, as indicated by the double arrow 70. In doing so, the sleeve 72 is pre-broken in the region of its lower edge concurrently with application of the primer.

Figure 9:
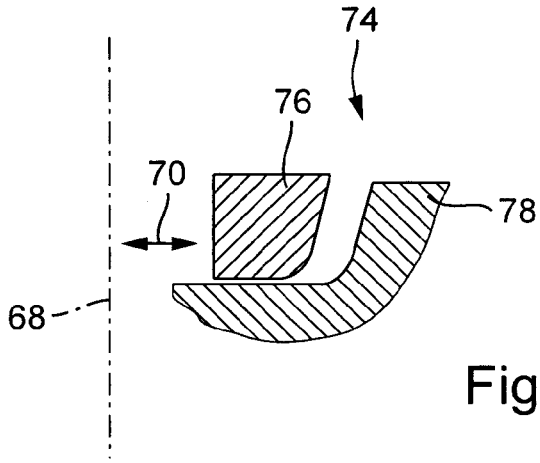
FIG. 9 is a part of another device of the invention for the application of adhesive.

FIG. 9 shows a part of another device 74 of the invention for the application of adhesive. Unlike the device 72, a stamp 76 and a counter tool 78 are curved outwardly in a lower corner region, as viewed from the central axis 68. At the same time as the application of adhesive to a sleeve, this sleeve is pre-broken at its lower edge in that the lower edge is bent downwardly in accordance with the curvatures provided on the stamp 76 and in the counter tool 78.

Figure 10:
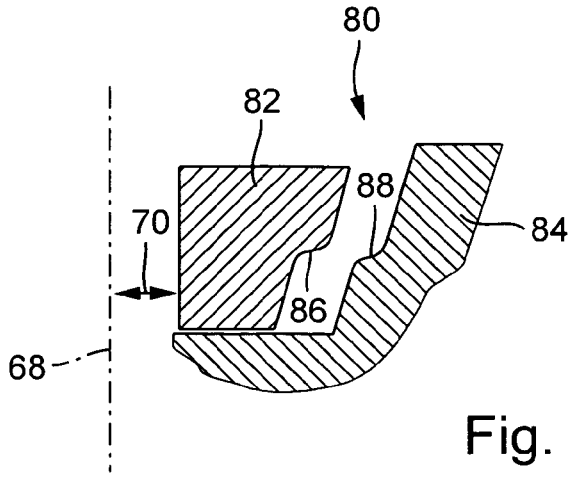
FIG. 10 is a section of another device of the invention for the application of adhesive.

FIG. 10 shows a section of another device 80 of the invention for the application of adhesive. A stamp 82 and a counter tool 84 are provided with matching steps 86, 88, at which the cross-sections of both the stamp 82 and the counter tool 84 decrease from top to bottom, as viewed from a direction extending parallel to the central longitudinal axis 68 as depicted in FIG. 10. The step is formed with rounded transitions. A sleeve inserted in the gap formed between the stamp 82 and the counter tool 84 is thus provided with adhesive and at the same time with a shoulder-like step in its lower region. As a result, the sleeve is pre-broken in the region of this step so that the sleeve can then be easily turned over in a defined manner in the region of this step when forming the skirt which joins the bottom element to the sleeve in order to create a cup that is leak-proof for liquids.

The invention claimed is:

1. A machine for the manufacture of paper cups from at least one paper segment, comprising a device for applying adhesive having a stamp for application of the adhesive, wherein said stamp is made of a compression-resistant porous sintered material, and wherein the device for applying adhesive is provided in a pre-breaking station for segment-wise shaping of the at least one paper segment by moving the stamp and a pre-breaking bar of the pre-braking station relatively towards each other, with the pre-breaking bar having a stamp receiving surface for capturing the at least one paper segment between the stamp and the pre-breaking bar to shape the at least one paper segment.

2. The machine as defined in claim 1, wherein a supply of adhesive from an adhesive supply line to an adhesive applying surface of said stamp is routed at least in part through the porous sintered material of said stamp.

3. The machine as defined in claim 2, wherein said adhesive applying surface has a curved shape.

4. The machine as defined in claim 3, wherein said adhesive applying surface is a segment of a sleeve of a circular cylinder.

5. The machine as defined in claim 1, wherein said sintered material is sintered metal.

6. The machine of claim 1, wherein an adhesive applying surface of the stamp and the stamp receiving surface have a corresponding curved contour to allow the adhesive applying surface and the stamp receiving surface to capture the at least one paper segment therebetween to form the at least one paper segment into a shape corresponding to the curved contour.

7. The machine of claim 6, wherein the adhesive applying surface is concave and the stamp receiving surface is convex.

8. The machine of claim 1, wherein the pre-breaking bar is stationary and the stamp moves toward the pre-breaking bar.

9. A machine for the manufacture of paper cups from at least one paper segment, comprising a device for applying adhesive having a stamp for application of the adhesive, wherein the stamp is made of a compression-resistant porous sintered material, and wherein the device for applying adhesive is provided in a pre-breaking station for segment-wise shaping of the at least one paper segment, with a pre-breaking bar of the pre-breaking station having a stamp receiving surface for capturing the at least one paper segment between the stamp and the pre-breaking bar to shape the at least one paper segment, wherein an adhesive applying surface of the stamp and the stamp receiving surface have a corresponding curved contour to allow the adhesive applying surface and the stamp receiving surface to capture the at least one paper segment therebetween to form the at least one paper segment into a shape corresponding to the curved contour.

10. The machine of claim 9, wherein the pre-breaking bar is stationary and the stamp moves toward the pre-breaking bar.

11. The machine of claim 9, wherein the adhesive applying surface is concave and the stamp receiving surface is convex.

* * * * *